US005196888A

United States Patent [19]

Matsuda et al.

[11] Patent Number: 5,196,888

[45] Date of Patent: Mar. 23, 1993

[54] METHOD OF FEEDING DEVELOPER TO DEVELOPING ZONE IN ELECTROPHOTOGRAPHY

[75] Inventors: Masanori Matsuda; Mamoru Kato, both of Tokyo; Takeshi Hori, Yokohama; Atsuhiko Irie, Tokyo; Tomiyasu Matsuda, Yokosuka, all of Japan

[73] Assignee: Mita Industrial Co., Ltd., Osaka, Japan

[21] Appl. No.: 704,883

[22] Filed: May 23, 1991

[30] Foreign Application Priority Data

May 30, 1990 [JP] Japan ..... 2-138600

[51] Int. Cl.[5] ..... G03G 15/09

[52] U.S. Cl. ..... 355/251; 118/658; 430/122

[58] Field of Search ..... 355/251, 253, 259, 261; 118/656, 657, 658, 651, 661; 430/122

[56] References Cited

U.S. PATENT DOCUMENTS

| | | | |
|---|---|---|---|
| 4,502,061 | 2/1985 | Ando et al. | 355/261 |
| 4,705,383 | 11/1987 | Hiraga et al. | 355/253 |
| 4,760,422 | 7/1988 | Seimiya et al. | 355/259 X |
| 4,780,741 | 10/1988 | Wada et al. | 355/253 |
| 4,916,492 | 4/1990 | Hoshika et al. | 355/253 |
| 4,935,785 | 6/1990 | Wildi et al. | 355/290 |
| 4,990,959 | 2/1991 | Yamamuro et al. | 118/657 X |
| 4,998,141 | 3/1991 | Altmann | 355/246 |

*Primary Examiner*—A. T. Grimley
*Assistant Examiner*—Robert Beatty
*Attorney, Agent, or Firm*—Sherman and Shalloway

[57] ABSTRACT

The method of feeding a developer according to the present invention is characterized by controlling the quantity of the developer fed to a developing zone, by the use of a member having on its surface an electret dielectric layer, which is used as an ear cutter. According to the present invention, the quantity of the developer being carried is controlled by the action of an electrostatic force exerted from the electret dielectric layer. Hence it becomes possible to effectively eliminate the density unevenness, charge unevenness of the developer and to obtain a stable image.

10 Claims, 3 Drawing Sheets

METHOD OF FEEDING DEVELOPER TO DEVELOPING ZONE IN ELECTROPHOTOGRAPHY

BACKGROUND OF THE INVENTION

1. Field of the Invention

The present invention relates to a method of feeding a developer to a developing zone in electrophotography. More particularly it relates to a method of feeding a developer capable of forming an image with a high density and less fog.

2. Description of the Prior Art

Magnetic brush development widely used in electrophotography is a process in which a two-component or one-component magnetic developer is electrostatically charged, the charged developer is fed onto a developer carrying member (a sleeve) provided with a magnet in its inside, and the developer is fed to a developing zone in the form of a magnetic brush. In the developing zone, an electrostatic image formed on the surface of a given photosensitive member is brushed with the magnetic brush to undergo development.

In this instance, the sleeve is provided above its surface with an ear-cutting member (an ear cutter) such as a doctor blade at a given interval. This ear cutter controls the ear length of the magnetic brush so that the developer may not be excessively fed and thus fog or density non-uniformity can be prevented from occurring.

However, the ear length of the magnetic brush is controlled only by a physical means wherein the magnetic brush is passed through the space between the ear cutter and the sleeve so that the magnetic brush is ear-cut.

Hence, in the case when the magnetic brush being ear-cut has a density or concentration unevenness of the developer, a corresponding density or concentration unevenness is necessarily brought to the magnetic brush being fed to the developing zone. For this reason, there is the problem that the image quality of an image obtained as result of development tends to become non-uniform.

In the magnetic brush being ear-cut, it is also possible that the developer is charged in an uneven state or a developer charged to a reverse polarity (the same polarity as the electrostatic image to be developed) is contained. In such instances, a problem arises in the density, image quality, etc. of the image obtained as result of development. The ear-cutting means described above can not evade such disadvantages.

Since the length of the magnetic brush is controlled only by the physical means between the ear cutter and the sleeve as stated above, there is another problem that the ear cutter must be provided in a highly precise and strict manner.

The above various problems are not limited to the magnetic brush development and are also seen in development processes in which a non-magnetic developer is used and the developer is transported only by an electrostatic force.

SUMMARY OF THE INVENTION

Accordingly, an object of the present invention is to provide a method of feeding a developer, that have effectively eliminated the disadvantages such as density unevenness, concentration unevenness and charge unevenness of developers.

Another object of the present invention is to provide a method of feeding a developer, that enables positional control of an ear-cutting member with great ease.

The present invention provides a method of feeding a developer used in a magnetic brush development process, comprising feeding a magnetic developer to a developing zone in the form of a magnetic brush controlled to have a given ear length using i) a developer carrying member having a magnet in its inside and ii) an ear-cutting member provided above said developer carrying member at an interval, wherein;

said ear-cutting member is provided on its surface with an electret dielectric layer.

The present invention also provides a method of feeding a developer, comprising feeding a charged non-magnetic developer to a developer carrying member to which a bias voltage has been applied, and feeding said developer to a developing zone, wherein;

the layer thickness of said developer carried on said carrying member is controlled by means of a blade or roller provided above said developer carrying member at an interval and having on its surface an electret dielectric layer.

DETAILED DESCRIPTION OF THE INVENTION

The electret is a dielectric that shows an action of permanent electrical polarization. It is a remarkable feature of the present invention that the ear-cutting member or ear cutter such as a doctor blade is provided on its surface with a layer comprising this electret dielectric. This makes it possible to achieve the objects previously set forth.

Figure 1A:
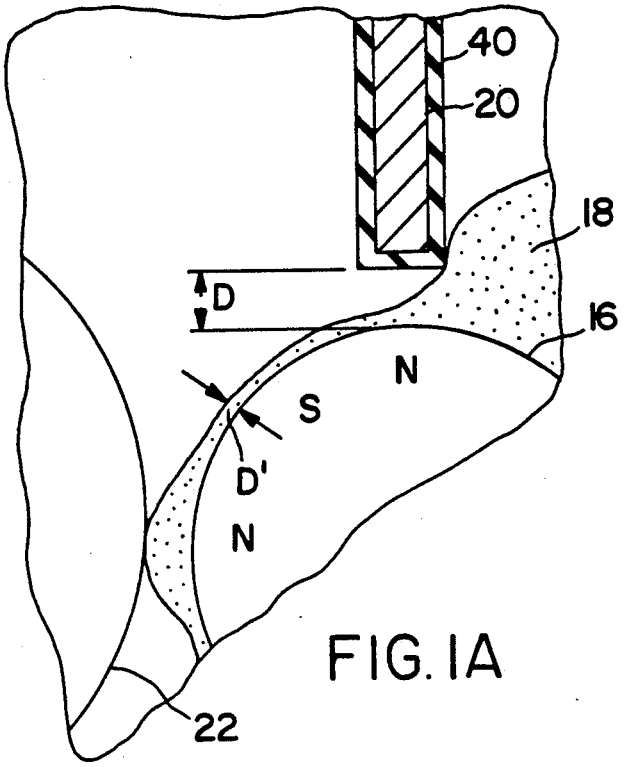
FIGS. 1A and 2A each illustrate the principle of the present invention in which a doctor blade is used.

In FIG. 1A, which illustrates this principle, the numeral 16 denotes a sleeve; 22, a photosensitive member; 18, a magnetic brush comprised of a developer; 20, a doctor blade; and 40, an electret layer. Magnetic developer particles are, for example, negatively charged. In the embodiments shown in FIG. 1, the electret layer 40 is so charged on its surface as to have the same polarity as the developer particles 18.

A magnet with a number of magnetic poles is provided at the inside of the sleeve 16. The developer is carried to the photosensitive member 22 in the form of a magnetic brush. In this instance, the ear length of the magnetic brush 18 comprised of the developer can be controlled to a certain extent by means of the blade 20. At the same time, the magnetic brush 18 that passes through the space (an ear cut gap) between the blade 20 and the sleeve 16 undergoes electrical repulsion from the electret 40 and is brought into a compressed state, where it has a smaller ear length D' than the width D of the ear cut gap.

More specifically, the magnetic brush 18 comprised of the developer is brought into a dense and void-free state. Hence, the developer fed to the photosensitive member 22 in the form of the magnetic brush 18 becomes uniform in its density or concentration. This means that, even when the density or concentration uneveness had occurred in a developer, such unevenness has been eliminated in the developer fed to the photosensitive member 22.

An electrostatic force is also applied from the electret 40 to the magnetic brush 18 passing through the ear cut gap. Hence, the non-uniformly charged state in the developer becomes uniform, resulting in, for example, a decrease in the proportion of uncharged particles, or particles charged to a reverse polarity, contained in the developer. Moreover, as described above, the ear length D' of the controlled magnetic brush is smaller than the width D of the ear cut gap. This means that the blade 20 can be provided at an interval larger than the width D of a conventional ear cut gap. Namely, in the present invention, the precision (the precision required for the width D of the ear cut gap) in which the blade 20 is fitted can be loose, so that the blade can be fitted with ease.

Figure 2A:
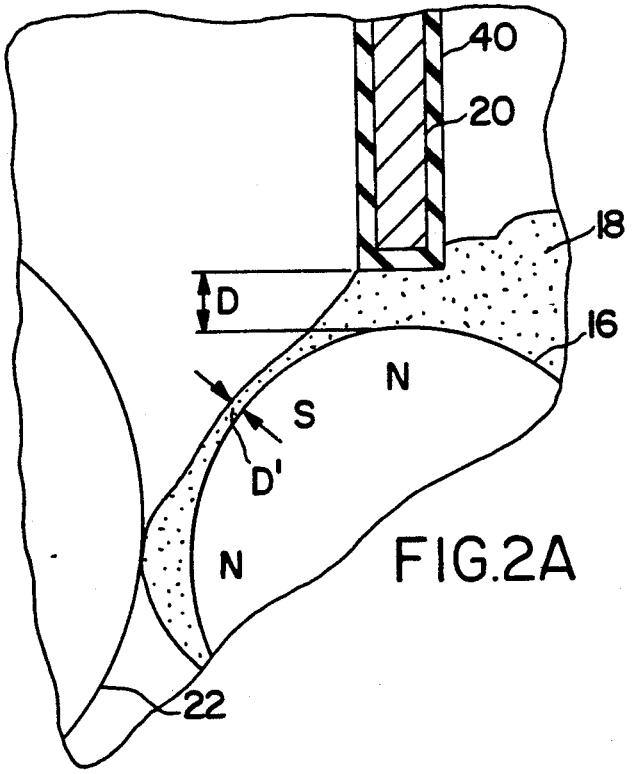

The above effect has been elucidated on the instance in which the outer surface of the electret layer 40 has been charged to the same polarity as the developer particles. The same also applies to an instance in which it is charged in a different polarity as shown in FIG. 2A. More specifically, in such an instance, the magnetic brush 18 passing through the ear cut gap undergoes electrical attraction to the electret 40 and is brought into an extended state. Hence, in this magnetic brush, the developer present near to the blade 20 is not carried forward but remains near the blade and the developer present near to the sleeve 16 is carried forward as a magnetic brush with an ear length D'.

Thus, the controlling of the ear length of the magnetic brush concerns the electrostatic force exerted from the electret 40 also when the outer surface of the electret layer 40 is charged to have a polarity reverse to that of the developer particles. Hence, like the instance previously set forth, the density or concentration of the developer and the charged state thereof can be made uniform and also the precision in which the blade 20 is fitted can be loose.

The charged state of the developer can be more remarkably made uniform especially when the outer surface of the electret layer 40 is charged to the same polarity as the developer.

In the present invention described above, the electret layer 40 should preferably have a thickness of 0.005 mm to 2 mm, and particularly 0.01 mm to 0.1 mm, and should preferably have a charge density (an absolute value) in the range of $5\times10^{-10}$ c/cm$^2$ to $2\times10^{-7}$ c/cm$^2$, and particularly $1\times10^{-9}$ c/cm$^2$ to $1.5\times10^{-7}$ c/cm$^2$. The thickness within the above range brings about a good workability. Its thickness has a great influence on the charge density. The charge density is improved with a decrease in the thickness of the electret layer. The charge density within the above range makes it possible for the developer passing the blade (i.e. the magnetic brush) to be in a thin layer with a good precision and also to have a uniform density. Moreover, it is possible to influence the charge of the developer to make the charge of the developer uniform. The electret layer 40 should preferably have a surface potential ES in the range of 200V to 1,000V, and particularly 300V to 900V.

The above electret layer 40 should also preferably have a surface roughness (Rz) in the range of 0.02 μm to 2 μm, and particularly 0.025 μm to 1 μm, in order for the magnetic brush 18 to be smoothly transported.

In the present invention, in particular, in the embodiment shown in FIG. 2A, the electret layer 40 should preferably be controlled to have a critical surface tension of 31 dyne/cm or less, and particularly 25 dyne/cm or less. More specifically, an electret layer 40 with a critical surface tension larger than the above range tends to result in adhesion of the developer to the surface of the blade 20, enabling no smooth movement of the developer on the surface of the electret layer, so that the density, etc. of the magnetic brush may become uneven.

According to the present invention, in view of the formation of an image with a stable density, the ear length D' of the magnetic brush controlled by the blade 20 should preferably be in the range of 0.5 mm to 1.5 mm in instances in which two-component magnetic developers are used, and 0.05 mm to 0.5 mm in instances in which one-component magnetic developers are used. In order to control the ear length in this way, it is preferred for the interval between the sleeve 16 and the blade 20, i.e., the width D of the ear cut gap to be usually set within the range of 0.05 mm to 2.0 mm, and particularly 0.1 mm to 1.5 mm.

The magnetic poles of the magnet provided in the sleeve 16 should have a relatively small magnetic flux density so long as no carrier attraction may occur, and should usually have a magnetic flux density of 400 gauss to 1,200 gauss, and particularly 500 gauss to 1,00C gauss.

As materials for the electret, any of organic materials and inorganic materials can be used so long as they can be permanently electrically polarized and have film forming properties. From the viewpoint of readiness for their formation into electrets and readiness for the formation of coatings, various polymeric materials are preferred. Preferred examples thereof are olefin resins such as polyethylene, polypropylene, an ethylene-butene copolymer, ionically crosslinked olefin copolymers, and an ethylene-acrylate copolymer; fluorine resins such as polyvinyl fluoride, polyvinylidene fluoride, a vinyl fluoride-vinylidene fluoride copolymer, ethylene tetrafluoride resins (PTFE), ethylene fluoride-perfluoroalkoxyethylene copolymer resins (PFA resins), and ethylene tetrafluoride-propylene hexafluoride copolymer resin (FEP resins); chlorine resins such as polyvinyl chloride, and chlorinated polyolefins; thermoplastic polyesters such as polyethylene terephthalate, polyethylene naphthalate, and polybutylene terephthalate; polyamides such as nylon 6, nylon 12, nylon 6,6, and nylon 6,10; and various acrylic resins. These may be used alone or in combination of two or more kinds. Of these, fluorine resins such as PTFE resin, PFA resins and FEP resin are preferred since they can achieve a good critical surface tension, a good charge retention and also a good durability.

The electret can be formed using any methods known per se, as exemplified by heat electret polarization, electroelectret polarization, radiation electret polarization and photoelectret polarization, which may be applied according to the types of the polymers used. The heat electret polarization or the electroelectret polarization can be advantageously applied to the above polymers, in particular, the fluorine resins.

The electret layer can be provided on the blade surface by a method in which a layer comprising a polymer film having been not polarized into an electret is provided on the surface of the blade surface and then this polymer film layer is polarized into an electret using the means described above, or a method in which a film having been polarized into an electret is stuck on the blade surface interposing an adhesive layer. The former method is advantageous in general.

According to the present invention, the blade 20 may also be comprised of a magnet blade so that the effect of controlling the ear length of the magnetic brush can be strengthened.

In this embodiment, the developer is transported according to a system in which the sleeve is set rotary and the magnet blade is set stationary, and the magnet blade is made to have the same polarity as the polarity of the magnet in the sleeve at the position opposed to the blade. That is to say, a magnetic repulsion is applied to the magnetic brush passing through the ear cut gap. Hence, in the embodiment shown in FIG. 1A, the compression of the magnetic brush can be promoted. In the embodiment shown in FIG. 2A, the adhesion of the developer to the surface of the electret 40 can be effectively controlled. In this instance, the magnet blade has, as a matter of course, a magnetic force smaller than the magnetic force of the magnet in the sleeve.

Figure 3A:
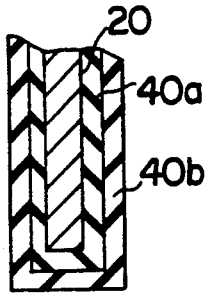
FIG. 3A illustrates a preferred embodiment of a doctor blade having two charged electret dielectric layers used in the method of the present invention.

According to the present invention, the electret 40 may be constituted in multi-layers, e.g. comprising an inner **40*a* and an outer 40*b*, as shown in FIG. 3A. This makes it possible to improve the charge retention stability on the surface of the electret 40, so that the action of controlling the ear length of the magnetic brush can be stably maintained over a long period of time. In this instance, the respective electret layers may be superposed either in the same polarity or in different polarities. They may usually be in the same polarity to achieve a better charge retention stability. It is unclear why the electret 40 constituted in multi-layers in this way brings about an improvement in the charge retention stability on the surface of the electret 40**. It, however, can be generally presumed that the polarized charges of the inner layer electret promotes the recovery of the charges of the outer layer electret. In this instance, each electret layer may preferably have a thickness, a charge density, etc. set within the ranges as previously described.

Figure 3B:
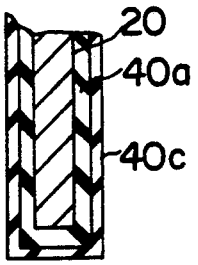
FIG. 3B illustrates an embodiment of the invention of a doctor blade having an electret dielectric layer and a protective layer.

According to the present invention, as shown in FIG. 3B, a protective dielectric layer **40*c* may be provided on the surface of the electret 40*a*, whereby the charges of the electret 40*a* can be stably retained. More specifically, since the blade 20 having the electret 40*a* on its surface is often subject to severe conditions such that it is subject to high temperature and high humidity or comes into contact with the developer. Hence, the surface charges of the electret 40*a* tend to be lost because of leak or the like. However, the loss of the surface charges can be effectively prevented when the above protective dielectric layer 40*c* is provided, so that the action of controlling the ear length of the magnetic brush as stated above can be stably maintained over a long period of time. In this instance, it is also possible to constitute the electret 40 in multilayers as previously described, e.g. 40*a* and 40*b*, FIG. 3A**, and provide thereon the protective dielectric layer.

In such an embodiment, it is advantageous for the protective dielectric layer **40*c* to have a thickness as small as possible so that its surface potential is not greatly lowered from the surface potential of the electret 40*a*. The thickness of the protective layer 40*c* may preferably be in the range of 5 μm to 100 μm, and particularly 10 μm to 50 μm. The surface roughness, the critical surface tension, etc. may also preferably be in the ranges previously described. Such a protective dielectric layer 40*c*** may be formed using the same polymeric materials as the materials for the electret as previously described, except that they are not polarized into electrets.

Figure 1B:
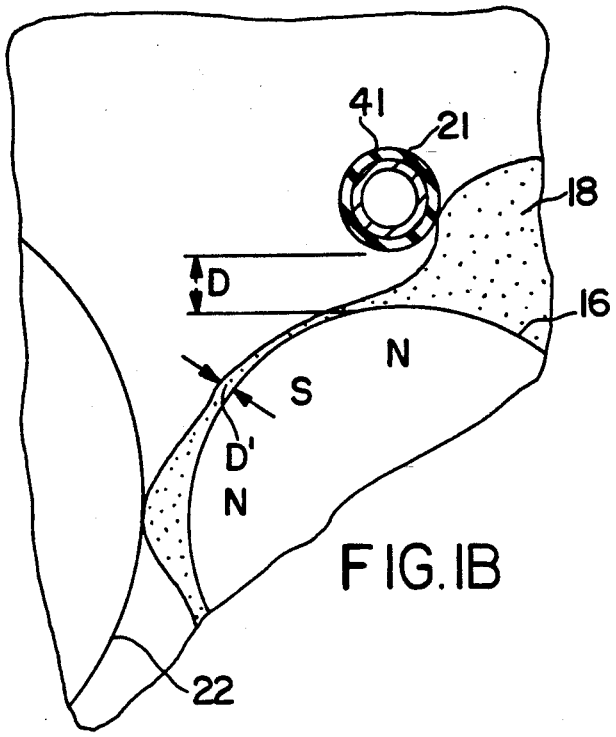
FIGS. 1B and 2B each illustrate the principle of the present invention in which a roller is used.
Figure 2B:
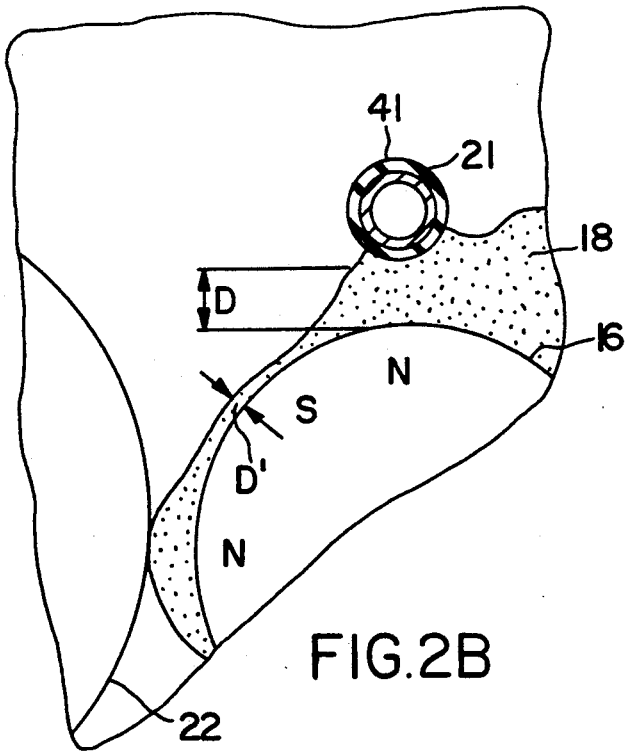

In the present invention described above, the ear cutter has been described as the doctor blade 20. Besides the doctor blade, it is also possible to use as the ear cutter a member having an arced surface as exemplified by a roller 21, as shown in FIG. 1B and 2B. In such an instance, the magnetic brush that passes through the ear cut gap can smoothly flow. Especially when the roller 21 is used, the roller is rotated as the magnetic brush flows and the electret surface 41 can be always brought into contact with the magnetic brush, so that the electrostatic force of the electret can effectively act on the magnetic brush.

Figure 4:
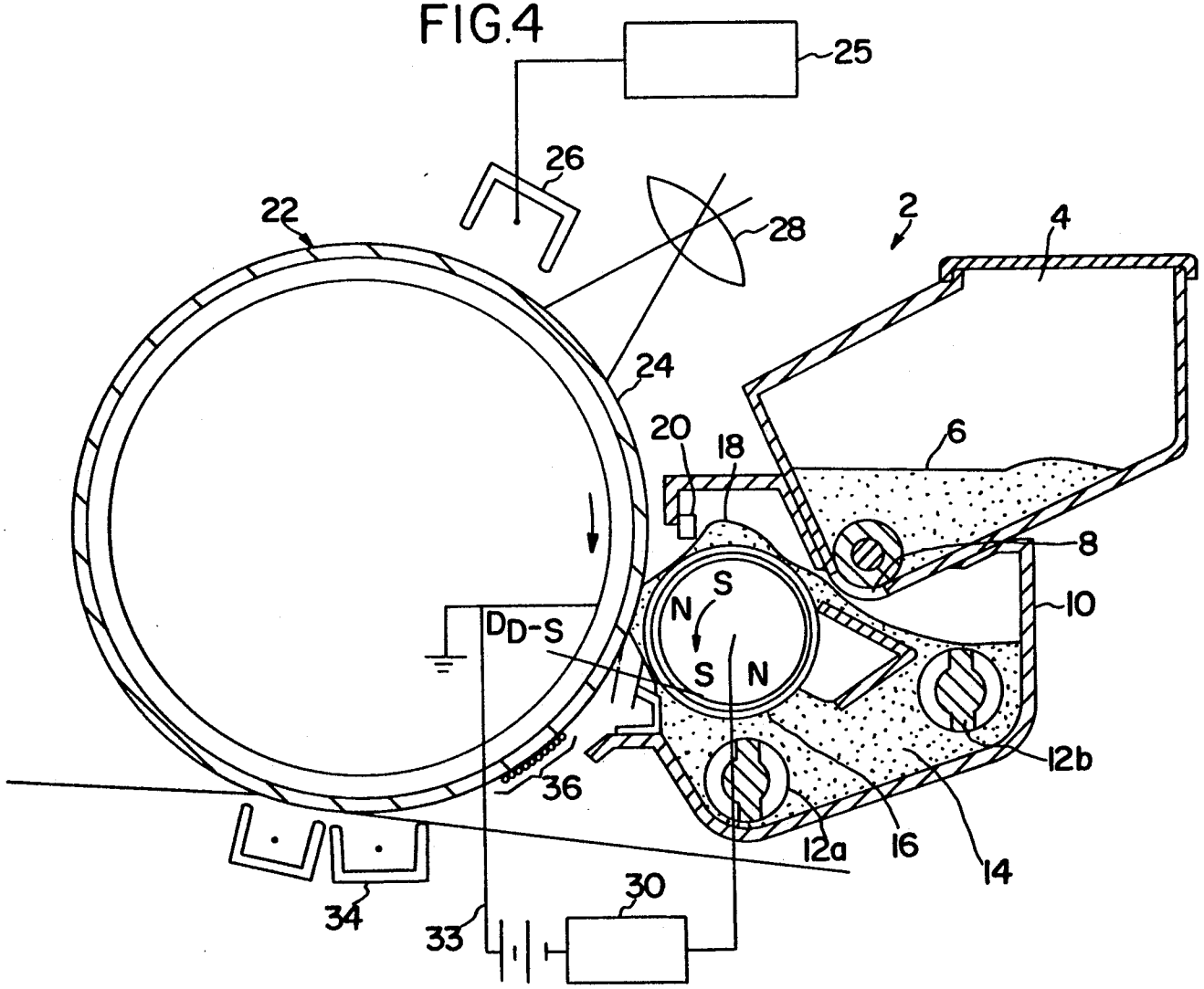
FIG. 4 illustrates a developing apparatus for preferably carrying out the method of the present invention.

FIG. 4 shows a developing apparatus used for preferably carrying out the method of the present invention.

As shown in FIG. 4, a developing apparatus 2 is provided with a box-like developer feeding mechanism 4, from the part above which a developer 6 is supplied. The developer 6 is fed through a feed opening 8 provided with a feeder, to a developing assembly 10, and stirred with stirrers **12*a* and 12*b*** provided in the developing assembly. The developer is thus triboelectrically charged.

The developing assembly 10 is provided therein with a developing sleeve 16 having a number of magnetic poles. A triboelectrically charged developer 14 is fed to the developing sleeve 16, and then a magnetic brush 18 comprised of the developer is formed on the sleeve surface. The magnetic brush is controlled by a doctor blade 20 to have a given ear length, and then carried to the nip position of a photosensitive layer 24 of a drum electrophotographic photosensitive member 22. The drum photosensitive member 22 is disposed at a distance $D_{D-S}$ from the developing sleeve 16. The developing sleeve 16 and the drum photosensitive member 22 are rotatably supported on a machine frame (not shown) and are driven in such a way that the directions in which they move at the nip position are the same (or reverse to each other).

Around the drum photosensitive member 22, a corona charger 26 connected to a variable high-voltage electric source 25 and an optical system 28 for exposure are provided on the upstream side of the developing assembly 10 so that an electrostatic latent image with a given surface potential can be formed. Between the drum photosensitive member 22 and the developing sleeve 16, a bias electric source 33 equipped with a voltage regulating mechanism 30 is connected and is so provided that a bias potential can be applied which has the same polarity as the surface potential on the photosensitive layer 24 and also is lower than this surface potential. A transfer mechanism 34 for transferring a developer image to copy paper is also provided around the photosensitive layer and on the downstream side of the developing zone.

With such constitution, the developer 14 forms the magnetic brush 18 on the developing sleeve 16. After having been controlled by the doctor blade 20 to have a given ear length, the magnetic brush is brought into contact, at the nip position, with a latent image formed on the photosensitive layer 24, so that a visible image of the developer is formed on the photosensitive layer 24. This visible image 36 is transferred to the copy paper by means of the transfer mechanism 34.

In the apparatus thus constituted, it is preferred for the developing sleeve 16 to be rotated at a relatively large revolution number so long as the developer does not fly about. In general, it should be rotated at a peripheral speed in the range of 5 cm/sec to 100 cm/sec, and particularly 10 cm/sec to 80 cm/sec. For the distance $D_{D\text{-}S}$ between the developing sleeve 16 and the photosensitive layer 24, it is suitable to be in the range of 0.5 mm to 3.5 mm in the case of two-component magnetic developers, and 0.1 mm to 1.0 mm in the case of one-component magnetic developers.

As the photosensitive member comprised of the above photosensitive layer 24, it is possible to use any photosensitive members conventionally used in electrophotography, as exemplified by a selenium photoconductor, an amorphous silicon photoconductor, a zinc oxide photoconductor, a cadmium selenide photoconductor, a cadmium sulfide photoconductor, and various organic photoconductors.

The two-component magnetic developer may preferably include, for example, those comprised of a toner and a magnetic carrier in a mixing proportion of 1:99 to 10:90, and particularly 2:98 to 5:95, in weight ratio. The toner and magnetic carrier that can be used may be any of those known per se, including, for example, those disclosed in U.S. Pat. No. 4,949,127.

The one-component magnetic developer may preferably include those containing a magnetic powder in an amount of 30% by weight to 70% by weight, and particularly 40% by weight to 60% by weight, based on the weight of a toner. The toner and magnetic carrier that can be used may include those disclosed in U.S. Pat. No. 4,401,741.

The above method of the present invention has been described giving an example for the magnetic brush development making use of a magnetic developer. Besides, this method can also be applied to developing processes making use of a non-magnetic developer. In such an instance, no magnet is provided in the sleeve 16 and a bias voltage is applied to the sleeve 16, where the developer is held and carried on the sleeve 16 by the action of electrostatic attraction. More specifically, the layer thickness of the developer being carried is controlled by the use of a blade or roller having on its surface the electret previously described. In this instance, the bias voltage applied to the sleeve 16 may range from 200V to 1,000V, and preferably from 300V to 900V.

The non-magnetic developer that can be used may include those obtained by removing the magnetic powder from the one-component magnetic developer described above. In such a method, it is preferred for the surface tension of the sleeve 16 to be set not more than 31 dyne/cm, and particularly not more than 25 dyne/cm to effect a smooth carrying of the developer.

The present invention will be described below by giving Examples.

EXAMPLE 1

The electret layer of a blade was formed of FEP resin. It was formed to have a thickness of 0.025 mm, a charge density of $-3.7\times10^{-8}$ c/cm$^2$, a surface potential of $-500$V, a surface tension of 17 dyne/cm and an average surface roughness of 0.025 μm, and made to have the same polarity as the charge of the charged developer.

The blade thus obtained was fitted to a reformed machine of an electrophotographic copier DC-112C, manufactured by Mita Industrial Co., Ltd., comprised of an amorphous selenium photoconductor, and images were transferred and fixed under the following conditions.

Peripheral speed of the photoconductor: 13.5 cm/sec

Peripheral speed of the developing sleeve: 27 cm/sec

Photosensitive layer/sleeve rotating directions: Regular

Magnetic pole in the sleeve: 800 gauss

Distance $D_{D\text{-}S}$ between the photosensitive layer and the sleeve: 0.2 mm Ear cut gap: 0.3 mm Developer: One-component magnetic developer Copies obtained had an image density of 1.36 and a fog density of 0.002.

The developer layer thickness (ear length) was 0.2 mm.

Image density unevenness was not more than 0.1.

EXAMPLE 2

The electret layer of a blade was formed of FEP resin. It was formed to have a thickness of 0.025 mm, a charge density of $4.5\times10^{-8}$ c/cm$^2$, a surface potential of 600V, a surface tension of 19 dyne/cm and an average surface roughness of 0.025 μm, and made to have the polarity reverse to the charge of the charged developer.

The blade thus obtained was fitted to a reformed machine of an electrophotographic copier DC-112C, manufactured by Mita Industrial Co., Ltd., comprised of an amorphous selenium photoconductor, and images were transferred and fixed under the following conditions.

Peripheral speed of the photoconductor: 13.5 cm/sec

Peripheral speed of the developing sleeve: 27 cm/sec

Photosensitive layer/sleeve rotating directions: Regular

Magnetic pole in the sleeve: 800 gauss

Distance $D_{D\text{-}S}$ between the photosensitive layer and the sleeve: 0.15 mm Ear cut gap: 0.3 mm Developer: One-component magnetic developer Copies obtained had an image density of 1.31 and a fog density of 0.003.

The developer layer thickness (ear length) was 0.15 mm.

Image density unevenness was not more than 0.08.

EXAMPLE 3

The electret layer of a blade was formed to have a thickness of 0.025 mm, a charge density of $-3.7\times10^{-8}$ c/cm$^2$, a surface tension of 18 dyne/cm, an average surface roughness of 0.025 μm and a surface potential ES of $-500$V, and made to have the same polarity as the charge of the charged developer.

The magnet of a blade substrate was set to have a magnetic flux density of 100 gauss and to have the same polarity as the magnetic pole on the opposed sleeve surface.

The ear cut gap was set to be 0.3 mm.

The blade thus obtained was fitted to a reformed machine of an electrophotographic copier DC-112C, manufactured by Mita Industrial Co., Ltd., comprised of an amorphous selenium photoconductor, and images were transferred and fixed under the following conditions.

Peripheral speed of the photoconductor: 13.5 cm/sec

Peripheral speed of the developing sleeve: 27 cm/sec

Photosensitive layer/sleeve rotating directions: Regular

Magnetic pole in the sleeve: 800 gauss

Distance $D_{D-S}$ between the photosensitive layer and the sleeve: 0.15 mm

Developer: One-component magnetic developer

Copies obtained had an image density of 1.37 and a fog density of 0.003.

The developer layer thickness (ear length) was 0.15 mm.

Image density unevenness was not more than 0.08.

EXAMPLE 4

A magnet blade was used as an ear cutter. The magnet thereof was set to have a magnetic flux density of 100 gauss and made to have the same polarity as the magnetic pole of the magnet positioned on the opposed sleeve surface.

The electret layer of a blade was formed to have a thickness of 0.025 mm, a charge density of $2.2\times10^{-8}$ c/cm$^2$, a surface tension of 17 dyne/cm, an average surface roughness of 0.025 μm and a surface potential ES of 300V, and made to have the polarity reverse to the charge of the charged developer.

The ear cut gap was set to be 0.4 mm.

The blade thus obtained was fitted to a reformed machine of an electrophotographic copier DC-112C, manufactured by Mita Industrial Co., Ltd., comprised of an amorphous selenium photoconductor, and images were transferred and fixed under the following conditions.

Peripheral speed of the photoconductor: 13.5 cm/sec

Peripheral speed of the developing sleeve: 27 cm/sec

Photosensitive layer/sleeve rotating directions: Regular

Magnetic pole in the sleeve: 800 gauss

Distance $D_{D-S}$ between the photosensitive layer and the sleeve: 0.2 mm

Developer: One-component magnetic developer

Copies obtained had an image density of 1.35 and a fog density of 0.002.

The developer layer thickness (ear length) was 0.2 mm.

Image density unevenness was not more than 0.1.

EXAMPLE 5

A blade was provided on its surface with a laminated electret comprised of the following inner and outer layers.

The outer electret layer was formed of FEP resin. It was formed to have a thickness of 0.025 mm, a charge density of $-3.7\times10^{-8}$ c/cm$^2$, a surface potential of $-500$V, a surface tension of 17 dyne/cm and an average surface roughness of 0.025 μm and made to have the same polarity as the charge of the charged developer.

The inner electret layer was formed of FEP resin. It was formed to have a thickness of 0.025 mm, a charge density of $3.7\times10^{-8}$ c/cm$^2$ and a surface potential of 500V. The electret layers have the same polarity each other at their joint surfaces.

The blade thus obtained was fitted to a reformed machine of an electrophotographic copier DC-12C, manufactured by Mita Industrial Co., Ltd., comprised of an amorphous selenium photoconductor, and images were transferred and fixed under the following conditions.

Peripheral speed of the photoconductor: 13.5 cm/sec

Peripheral speed of the developing sleeve: 27 cm/sec

Photosensitive layer/sleeve rotating directions: Regular

Magnetic pole in the sleeve: 800 gauss

Distance $D_{D-S}$ between the photosensitive layer and the sleeve: 0.2 mm

Ear cut gap: 0.3 mm

Developer: One-component magnetic developer

Copies obtained had an image density of 1.37 and a fog density of 0.003.

The developer layer thickness (ear length) was 0.2 mm.

Image density unevenness was not more than 0.09.

EXAMPLE 6

A blade was provided on its surface with a laminated electret comprised of the following inner and outer layers.

The outer electret layer was formed of FEP resin. It was formed to have a thickness of 0.0125 mm, a charge density of $8.9\times10^{-8}$ c/cm$^2$, a surface potential of 600V, a surface tension of 19 dyne/cm and an average surface roughness of 0.025 μm and made to have the polarity reverse to the charge of the charged developer.

The inner electret layer was formed of FEP resin. It was formed to have a thickness of 0.0125 mm, a charge density of $-8.9\times10^{-8}$ c/cm$^2$ and a surface potential of $-600$V. The electret layers have the same polarity each other.

The blade thus obtained was fitted to a reformed machine of an electrophotographic copier DC-112C, manufactured by Mita Industrial Co., Ltd., comprised of an amorphous selenium photoconductor, and images were transferred and fixed under the following conditions.

Peripheral speed of the photoconductor: 13.5 cm/sec

Peripheral speed of the developing sleeve: 27 cm/sec

Photosensitive layer/sleeve rotating directions: Regular

Magnetic pole in the sleeve: 800 gauss

Distance $D_{D-S}$ between the photosensitive layer and the sleeve: 0.15 mm

Ear cut gap: 0.3 mm

Developer: One-component magnetic developer

Copies obtained had an image density of 1.34 and a fog density of 0.002.

The developer layer thickness (ear length) was 0.15 mm.

Image density unevenness was not more than 0.08.

EXAMPLE 7

A blade was provided on its surface with the following electret layer and further provided thereon with the following protective dielectric layer.

The electret layer of a blade was formed of FEP resin. It was formed to have a thickness of 0.025 mm, and a charge density of $-3.7\times10^{-8}$ c/cm$^2$, and made to have the same polarity as the charge of the charged developer.

The protective dielectric layer was also formed of FEP resin. It was formed to have a thickness of 0.01 mm, a surface tension of 18 dyne/cm and a surface roughness of 0.025 μm.

The blade thus obtained was fitted to a reformed machine of an electrophotographic copier DC-112C, manufactured by Mita Industrial Co., Ltd., comprised of an amorphous selenium photoconductor, and images were transferred and fixed under the following conditions.

Peripheral speed of the photoconductor: 13.5 cm/sec
Peripheral speed of the developing sleeve: 27 cm/sec
Photosensitive layer/sleeve rotating directions: Regular
Magnetic pole in the sleeve: 800 gauss
Distance $D_{D-S}$ between the photosensitive layer and the sleeve: 0.2 mm
Ear cut gap: 0.3 mm
Developer: One-component magnetic developer
Copies obtained had an image density of 1.36 and a fog density of 0.002.

The developer layer thickness (ear length) was 0.2 mm.

Image density unevenness was not more than 0.08.

EXAMPLE 8

A blade was provided on its surface with the following electret layer and protective dielectric layer in the same manner as in Example 7.

The electret layer of a blade was formed of FEP resin. It was formed to have a thickness of 0.0125 mm, and a charge density of $8.9\times10^{-8}$ c/cm$^2$, and made to have the same polarity as the charge of the charged developer.

The protective dielectric layer was also formed of FEP resin. It was formed to have a thickness of 0.01 mm, a surface tension of 18 dyne/cm and a surface roughness of 0.025 μm.

The blade thus obtained was fitted to a reformed machine of an electrophotographic copier DC-112C, manufactured by Mita Industrial Co., Ltd., comprised of an amorphous selenium photoconductor, and images were transferred and fixed under the following conditions.

Peripheral speed of the photoconductor: 13.5 cm/sec
Peripheral speed of the developing sleeve: 27 cm/sec
Photosensitive layer/sleeve rotating directions: Regular
Magnetic pole in the sleeve: 800 gauss
Distance $D_{D-S}$ between the photosensitive layer and the sleeve: 0.15 mm
Ear cut gap: 0.2 mm
Developer: One-component magnetic developer
Copies obtained had an image density of 1.37 and a fog density of 0.003.

The developer layer thickness (ear length) was 0.15 mm.

Image density unevenness was not more than 0.1.

EXAMPLE 9

The electret layer of a blade was formed of FEP resin. It was formed to have a thickness of 0.025 mm, an average surface roughness of 0.35 μm, a charge density of $-4.5\times10^{-8}$ c/cm$^2$, a surface potential of −600V, a surface tension of 19 dyne/cm and an average surface roughness of 0.025 μm, and made to have the same polarity as the charge of the charged developer.

The blade thus obtained was fitted to a reformed machine of an electrophotographic copier DC-112C, manufactured by Mita Industrial Co., Ltd., comprised of an amorphous selenium photoconductor, and images were transferred and fixed under the following conditions.

Peripheral speed of the photoconductor: 13.5 cm/sec
Surface tension of the developing sleeve: 21 dyne/cm
Peripheral speed of the developing sleeve: 27 cm/sec
Photosensitive layer/sleeve rotating directions: Regular
Distance $D_{D-S}$ between the photosensitive layer and the sleeve: 0.2 mm
Ear cut gap: 0.3 mm
Bias voltage applied to the developing sleeve: 800V
Developer: One-component non-magnetic developer
Copies obtained had an image density of 1.32 and a fog density of 0.002.

The developer layer thickness (ear length) was 0.2 mm.

Image density unevenness was not more than 0.09.

EXAMPLE 10

The electret layer of a blade was formed of FEP resin. It was formed to have a thickness of 0.025 mm, an average surface roughness of 0.275 μm, a charge density of $3.7\times10^{-8}$ c/cm$^2$, a surface potential of 500V, a surface tension of 17 dyne/cm and an average surface roughness of 0.025 μm, and made to have the polarity reverse to the charge of the charged developer.

The blade thus obtained was fitted to a reformed machine of an electrophotographic copier DC-112C, manufactured by Mita Industrial Co., Ltd., comprised of an amorphous selenium photoconductor, and images were transferred and fixed under the following conditions.

Peripheral speed of the photoconductor: 13.5 cm/sec
Peripheral speed of the developing sleeve: 27 cm/sec
Photosensitive layer/sleeve rotating directions: Regular
Distance $D_{D-S}$ between the photosensitive layer and the sleeve: 0.15 mm
Ear cut gap: 0.25 mm
Bias voltage applied to the developing sleeve: 800V
Surface tension of the developing sleeve: 19 dyne/cm
Developer: One-component non-magnetic developer
Copies obtained had an image density of 1.34 and a fog density of 0.003.

The developer layer thickness (ear length) was 0.15 mm.

Image density unevenness was not more than 0.1.

What is claimed is:

1. A method of uniformly feeding a magnetic developer in the form of a magnetic brush to a developing zone which comprises providing an electrostatic charge to the magnetic developer, feeding the developer to a developer carrier sleeve having an outer magnetic surface to attract the developer and to coat the outer surface with a layer of a thickness of developer to form a magnetic brush, feeding the developer on the sleeve to have the developer pass under an ear-cutting member spaced 0.05 to 2.0 mm above the surface of the sleeve, said ear-cutting member forming an ear cut gap between the sleeve surface and the ear-cutting member, said ear-cutting member reducing the thickness of the magnetic brush as the brush passes thereunder to a thickness about equal to the size of the ear cut gap, providing said ear-cutting member with a coating of a layer of an electret dielectric material having a charge density of $5\times10^{-10}$ c/cm$^2$ to $2\times10^{-7}$ c/cm$^2$ and a charge the same as that of the developer and sufficient to repel and compress to a smaller and uniform thickness the layer of developer forming the magnetic brush, and compressing said layer of developer to a uniform thickness and feeding the compressed developer layer of uniform thickness to the developing zone and to a nip position between the sleeve surface and a photosensitive surface of an electrophotographic drum disposed in operable relationship to the sleeve to develop an image on the surface of the drum.

2. The method of feeding a developer according to claim 1 wherein the ear-cutting member is spaced 0.01 to 0.1 mm above the surface of the sleeve.

3. The method of feeding a developer according to claim 1 wherein the electret dielectric material has a charge density of $1\times10^{-9}$ to $1.5\times10^{-7}$ c/cm$^2$.

4. A method of feeding a developer according to claim 1 wherein the ear-cutting member comprises a doctor blade.

5. A method of feeding a developer according to claim 1 wherein the ear-cutting member comprises a roller.

6. A method of uniformly feeding a non-magnetic developer in the form of a non-magnetic brush to a developing zone which comprises providing an electrostatic charge to the non-magnetic developer, feeding the developer to a developer carrier sleeve having an outer non-magnetic surface to which a bias voltage has been applied to attract the developer and to coat the outer surface with a layer of a thickness of developer to form a non-magnetic brush, feeding the developer on the sleeve to have the developer pass under an ear-cutting member spaced 0.05 to 2.0 mm above the surface of the sleeve, said ear-cutting member forming an ear cut gap between the sleeve surface and the ear-cutting member, said ear-cutting member reducing the thickness of the non-magnetic brush as the brush passes thereunder to a thickness about equal to the size of the ear cut gap, providing said ear-cutting member with a coating of a layer of an electret dielectric material having a charge density of $5\times10^{-10}$ c/cm$^2$ to $2\times10^{-7}$ c/cm$^2$ and a charge the same as that of the developer and sufficient to repel and compress to a smaller and uniform thickness the layer of developer forming the non-magnetic brush, compressing said layer of developer to a uniform thickness and feeding the compressed developer layer of uniform thickness to the developing zone and to a nip position between the sleeve surface and a photosensitive surface of an electrophotographic drum disposed in operable relationship to the sleeve to develop an image on the surface of the drum.

7. The method of feeding a developer according to claim 6, wherein the ear-cutting member is spaced 0.01 to 0.1 mm above the surface of the sleeve.

8. The method of feeding a developer according to claim 6 wherein the electret dielectric material has an electrostatic charge density of $1\times10^{-9}$ to $1.5\times10^{-7}$ c/cm$^2$.

9. A method of feeding a developer according to claim 6 wherein the ear-cutting member comprises a doctor blade.

10. A method of feeding a developer according to claim 6 wherein the ear-cutting member comprises a roller.

* * * * *